US006696941B2

(12) United States Patent
Baker

(10) Patent No.: US 6,696,941 B2
(45) Date of Patent: Feb. 24, 2004

(54) THEFT ALARM IN MOBILE DEVICE

(75) Inventor: Thomas W. Baker, Orefield, PA (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/944,367

(22) Filed: Sep. 4, 2001

(65) Prior Publication Data

US 2003/0043034 A1 Mar. 6, 2003

(51) Int. Cl.[7] ..... G08B 1/08

(52) U.S. Cl. ..... 340/539.1; 340/539.11; 340/539.32; 340/568.1; 340/568.7; 340/572.1; 340/572.8; 455/38.1; 455/38.2

(58) Field of Search ..... 340/539.1, 593.11, 340/539.13, 539.15, 568.1, 571, 825.36, 7.1, 7.2, 7.58, 7.6, 7.61, 7.62, 539.32, 568.7; 455/38.2, 38.1

(56) References Cited

U.S. PATENT DOCUMENTS 5,307,059 A * 4/1994 Connary et al. ..... 340/7.1
5,504,476 A * 4/1996 Marrs et al. ..... 340/7.1
5,970,389 A * 10/1999 Lewiner et al. ..... 455/31.2
6,075,456 A * 6/2000 Park ..... 340/7.1
6,160,477 A * 12/2000 Sandelman et al. ..... 340/506
6,198,390 B1 * 3/2001 Schlager et al. ..... 340/540
6,297,737 B1 * 10/2001 Irvin ..... 340/571

* cited by examiner

*Primary Examiner*—Daryl Pope
(74) *Attorney, Agent, or Firm*—William H. Bollman

(57) ABSTRACT

A system and method for remotely triggering an audible alarm within a mobile phone is disclosed. A remote user calls the mobile phone and enters a personal identification number (PIN) attached to a remote calling device. The PIN is processed either within the mobile phone or within a central service. The PIN is compared to a pre-stored PIN. A match between the previously stored PIN and the PIN entered by the user produces a signal that triggers an audible alarm within mobile phone to deter theft and assist in recovery of a stolen mobile phone.

24 Claims, 7 Drawing Sheets

THEFT ALARM IN MOBILE DEVICE

BACKGROUND OF THE INVENTION

1. Field of the Invention

This invention relates generally to providing an audible alarm for a mobile phone. More particularly, it relates to a system and method for activating an audible alarm for a mobile phone to deter theft and assist in locating the mobile phone.

2. Background of Related Art

Mobile phones, Personal Digital Assistants, and other mobile wireless devices are small, portable, and easily stolen. If a mobile phone or other hardware is stolen, there is liability that the their will use the stolen mobile device, causing the user to be billed for services initiated by the thief.

One conventional way to protect a mobile phone or mobile wireless device is to add a lock/unlock personal identification number (PIN) to lock and unlock the device. Using such a system, the device becomes disabled until a lock/unlock PIN is entered that matches a pre-stored lock/unlock PIN in memory of the mobile phone.

FIG. 5 illustrates a conventional mobile phone comprising an external antenna 1, an on/off button 2, a speaker 3, a cancel button 4, a menu selection button 5, scroll buttons 6 and 7, a numerical keypad 8, and a microphone 9.

In particular, as shown in FIG. 5, one conventional type mobile phone has a menu selection button 5 for access to a menu that will lock and unlock the device. Scroll buttons 6 and 7 allow a user to scroll through a menu system to choose a desired function. Once a lock and/or unlock menu is entered, the numerical keypad 8 is used to enter a lock/unlock PIN that the user will later use to both lock or unlock the device. The cancel button 4 may be depressed if the user mistakenly enters an incorrect lock/unlock PIN or wants to exit the current menu function.

FIG. 6 is a flow chart showing an exemplary process by which a lock/unlock PIN number is initially setup for use on a mobile phone.

In particular, as shown in FIG. 6, a software routine monitors keyboard entries to determine if a locking setup menu is chosen 10. If the locking setup menu 10 is not chosen, the software routine loops to continuously monitor if the user desires to enter the locking setup menu.

Once the user desires to enter the locking setup menu, a routine is called that requires a user to enter a lock/unlock PIN that will be used to lock or unlock the mobile wireless device 11.

A conventional method of assuring that a user enters the correct lock/unlock PIN is to have the user re-enter the lock/unlock PIN at routine 12. The lock/unlock PIN entered in routine 11 is compared with the lock/unlock PIN entered in routine 12. If the lock/unlock PIN entered in routine 11 is not the same as the lock/unlock PIN entered in routine 12, the program jumps back to routine 11 to force the user to begin the process over again to establish a lock/unlock PIN. If the lock/unlock PIN entered in routine 11 is the same as the lock/unlock PIN entered in routine 12, the program progresses to store the lock/unlock PIN 14.

The lock/unlock PIN is preferably stored in non-volatile memory. Non-volatile memory allows the lock/unlock PIN number to be maintained even without a constant source of power. The lock/unlock PIN would not be inadvertently erased if the battery power were allowed to run down, and a thief would not be able to erase the lock/unlock PIN by simply removing the battery pack.

FIG. 7 is a flow chart showing an exemplary process by which a lock/unlock PIN number is entered to lock or unlock a mobile phone.

In particular, as shown in FIG. 7, a software routine monitors if a lock and unlock menu is chosen 16. If the lock and unlock menu 16 is not chosen, the software routine loops to continuously monitor if user desires to enter the lock and unlock menu 16. Once the user enters the lock and unlock menu, a routine is called that requires a user to enter a lock/unlock PIN 17 that will be used to lock and unlock the mobile phone.

The entered lock/unlock PIN is compared to the lock/unlock PIN previously stored in memory 18 to determine if the proper lock/unlock PIN has been entered by the user. If the lock/unlock PIN entered by the user is not the same as the lock/unlock PIN stored in memory, the program branches back to the routine that requires the user to enter a lock/unlock PIN 17. If the lock/unlock PIN entered by the user is the same as the lock/unlock PIN stored in memory, the program continues on to determine the current state of the phone, either locked or unlocked 19. If a mobile phone is in a locked condition, a software routine unlocks the mobile phone to allow full functionality for the user at step 20. If the mobile phone is in an unlocked condition, the software routine locks the mobile phone 21. Once either the unlocking routine 20 or the locking routine 21 are completed, the lock/unlock menu function is exited at step 22.

Locking a mobile phone prevents further use, but does not assist a user in finding their mobile phone, nor does it deter a thief from hiding the phone on their person.

There exists a need for an apparatus and method that discourages theft of a mobile phone, or if stolen, assists the owner in locating their stolen mobile phone.

SUMMARY OF THE INVENTION

In accordance with the principles of the present invention, a mobile phone having an alarm capable of being remotely triggered comprises a remote trigger detection element. The remote trigger detection element responds to an alarm personal identification number (PIN) entered by a remote user to produced an alarm signal. The alarm signal triggers an audible alarm within the mobile phone.

A mobile phone having an alarm capable of being remotely triggered in accordance with another aspect of the present invention comprises a remote trigger detection element. A remote user enters an alarm PIN from a remote location from the mobile phone. The alarm PIN is compared with a previously stored user alarm PIN for the mobile phone at a central location. A match between alarm PINs causes an alarm activation signal to be produced. If the PIN is stored at a central location, the alarm activation signal is transmitted to the mobile phone. The mobile phone receives the alarm activation signal and activates an audible alarm.

A mobile phone having an alarm capable of being remotely triggered in accordance with another aspect of the present invention comprises a audible alarm disabling element. An alarm PIN is entered into the mobile phone. The alarm PIN is compared to a previously stored alarm PIN within memory. A match between alarm PINs causes an active audible alarm to become disabled.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

The present invention provides a method and apparatus for remotely triggering an audible alarm in a wireless device such as a mobile phone.

Figure 1:
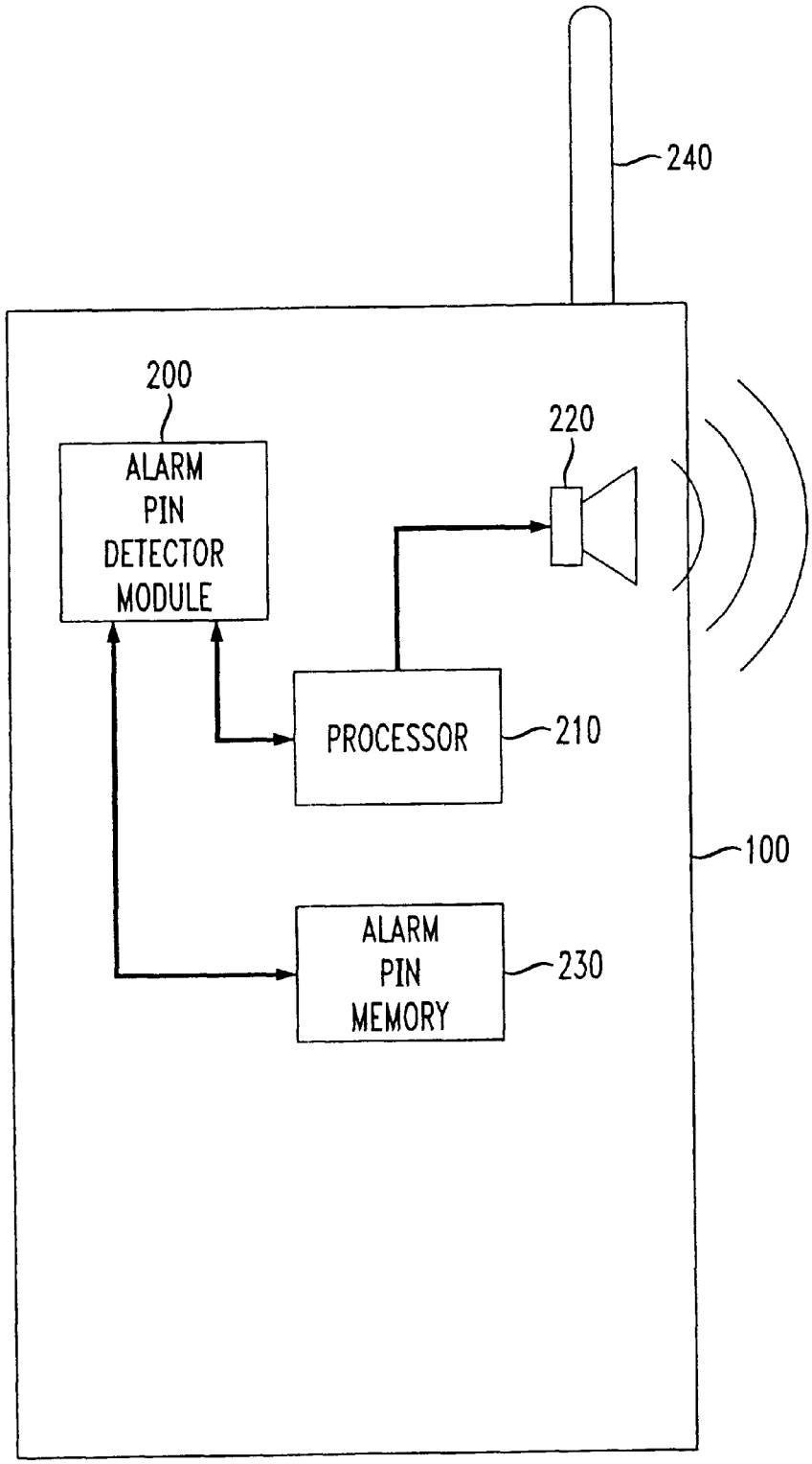
FIG. 1 shows a mobile phone having an alarm PIN detection module in accordance with the principles of the present invention.

FIG. 1 shows a mobile phone having an alarm PIN detection module in accordance with the principles of the present invention.

In particular, FIG. 1 shows a mobile phone 100 comprising an alarm PIN detection module 200, a processor 210, and an alarm PIN memory 230, an antenna, and a speaker 220.

In operation, the mobile phone 100 receives through its antenna 240 the alarm PIN used to both activate and/or deactivate the audible alarm produced by the speaker 220.

An incoming data signal containing conventional cellular data also contains an alarm PIN value. The incoming data signal including the alarm PIN is processed by the processor 210 to separate the PIN from extraneous data received through antenna 240. Processor 210 transfers the received alarm PIN to the alarm PIN detection module 200.

Alarm PIN detection module 200 compares the alarm PIN received through antenna 240 with a previously stored alarm PIN in alarm PIN memory 230. If alarm PIN detection module 200 determines that a match exists between the alarm PIN received through antenna 240 and the alarm PIN stored in 230, alarm PIN detection module instructs processor 210 to activate the speaker 220 to produce an audible alarm. The audible alarm produced by speaker 240 is used by a victim to locate the stolen mobile phone 100.

Figure 2:
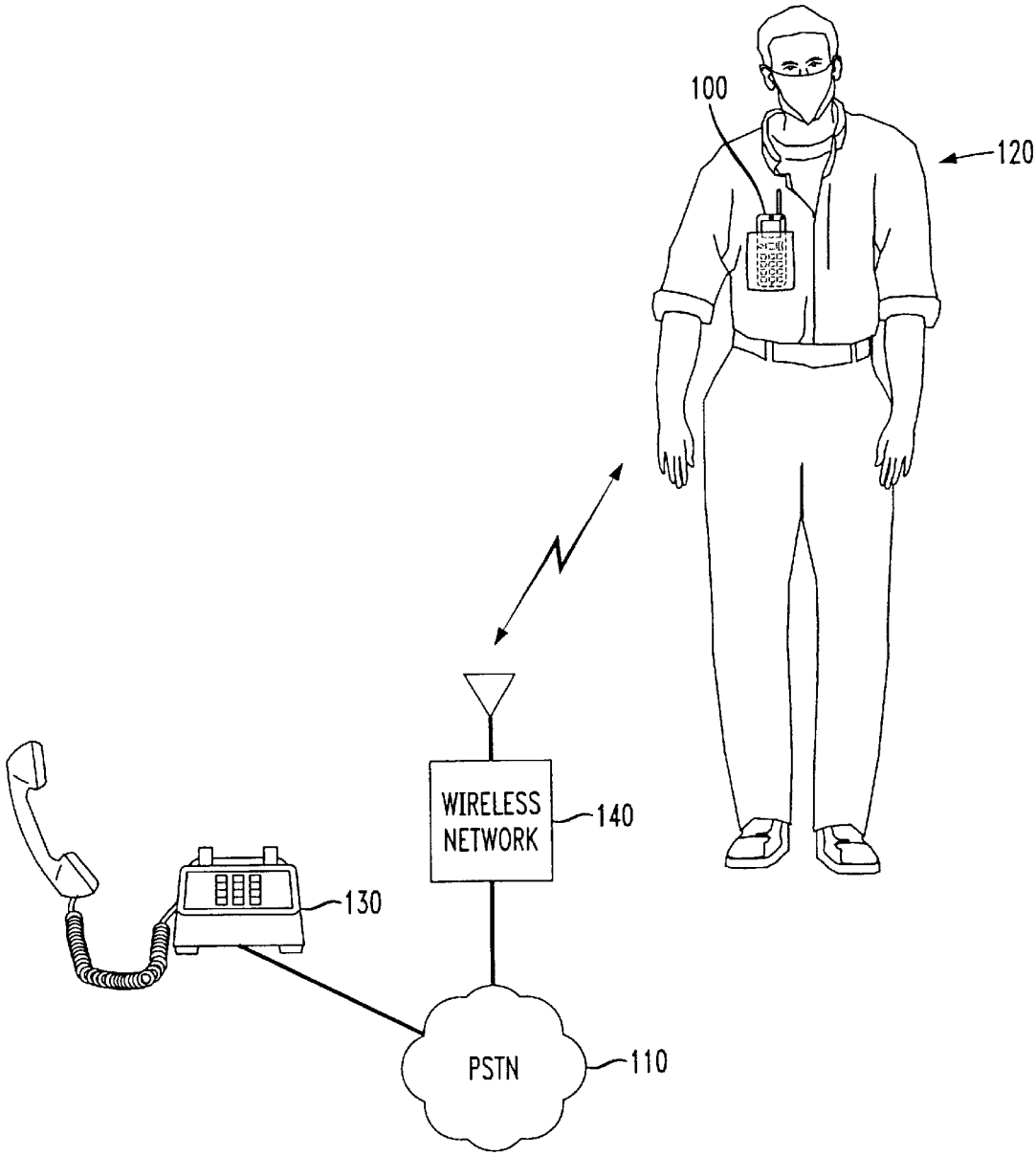
FIG. 2 shows a conventional phone connected to a PSTN used to call a stolen mobile phone in accordance with the principles of the present invention.

FIG. 2 shows a phone 130 connected to a wired phone system 110 used to call a stolen mobile phone 100.

In particular, a conventional phone 130 is used in a conventional manner to place a call over a public service telephone network (PSTN) 110. The victim calls their own phone number in addition to entering the alarm PIN used to activate the theft alarm on the mobile phone. The call is routed in a conventional manner through a PSTN 110 to a cellular wireless network 140.

The call reaches a phone 100 over the cellular wireless network 140. The alarm PIN entered by the victim is also transferred to the stolen mobile phone 100. Upon reception of the alarm PIN by the mobile phone 100, the speaker 220 within the phone (as shown in FIG. 1) is activated to produce an audible tone that allows the victim to locate the mobile phone being held by a thief 120.

The alarm PIN transferred to the stolen mobile phone 100 can occur whether the phone is taken off-hook or remains on-hook. In a similar manner that a mobile phone receives information, such as caller ID, the stolen mobile phone receives the alarm PIN data.

If the stolen mobile phone 100 is powered off when a thief has stolen the mobile phone, the alarm PIN is periodically transmitted by the cellular wireless network 140 to activate the speaker 220 once the phone is turned on. A confirmation signal is then transmitted back to the cellular wireless network 140 confirming the activation of the speaker 220, ending the need to periodically transmit the alarm PIN to the mobile phone 100.

Activation of the audible alarm over speaker 220 even when outside of the victim hearing range still has the deterrent effect of alerting others that a thief 120 is near. This encourages a thief 120 to abandon the stolen mobile phone 100, assisting the victim in recovering the mobile phone 100.

Figure 3:
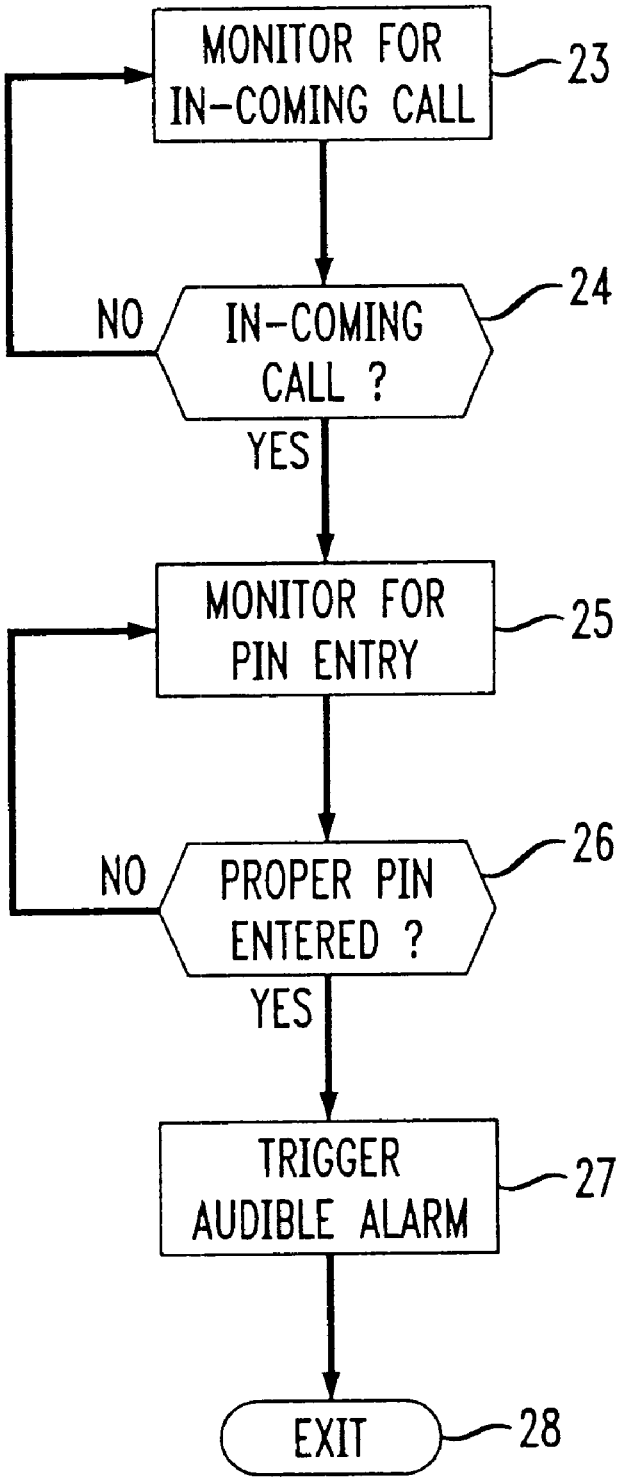
FIG. 3 shows a flowchart for monitoring for an alarm PIN and triggering an audible alarm, in accordance with the principles of the present invention.

FIG. 3 shows a flowchart utilized to activate an audible alarm of a mobile phone, in accordance with a first embodiment of the present invention.

In particular, FIG. 3 shows an exemplary process to activate a mobile device such as a mobile phone.

In step 23, a software routine within the mobile phone monitors for an incoming call 23.

In step 24, a decision is made if an incoming call has been received by the mobile phone.

If no incoming call has been received, the program loops back to step 23 to continuously monitor for an incoming call.

In step 25, if an incoming call is available, the program continues to monitor for an alarm PIN entry from a remote user desiring to access the mobile phone.

Figure 6:
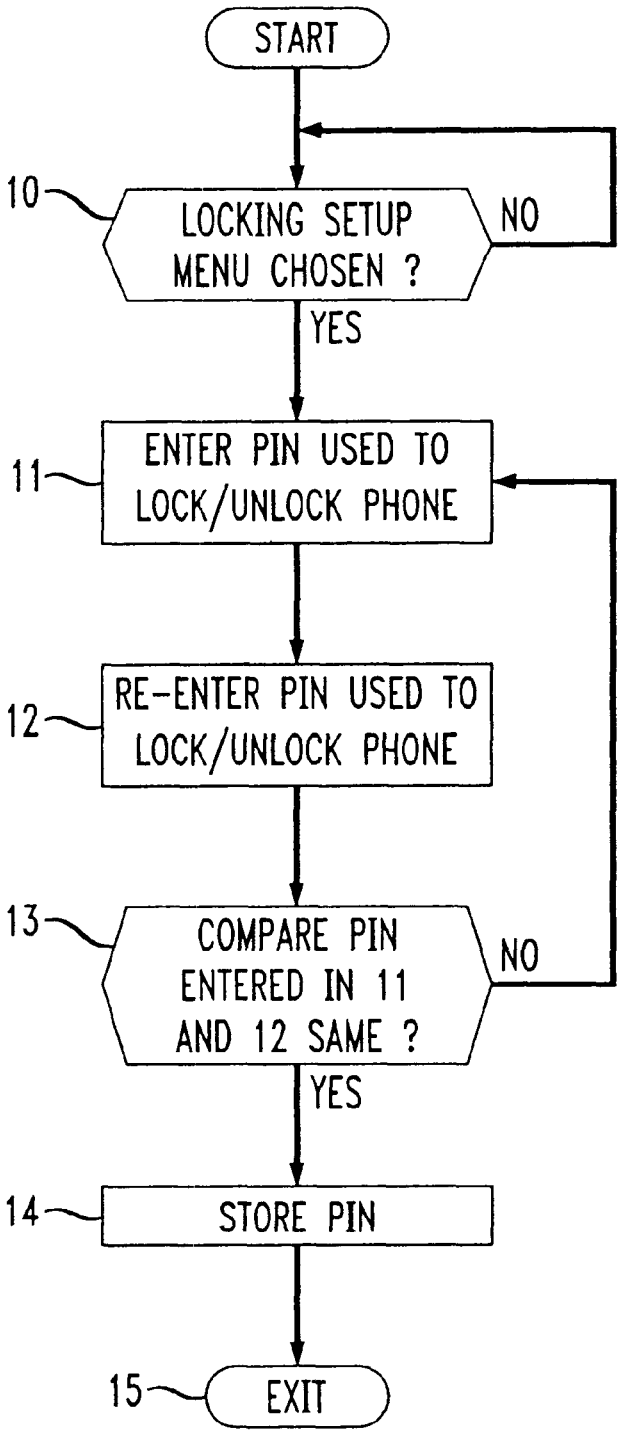
FIG. 6 PRIOR ART
FIG. 6 shows a conventional flowchart of setting up a locking PIN number.
Figure 7:
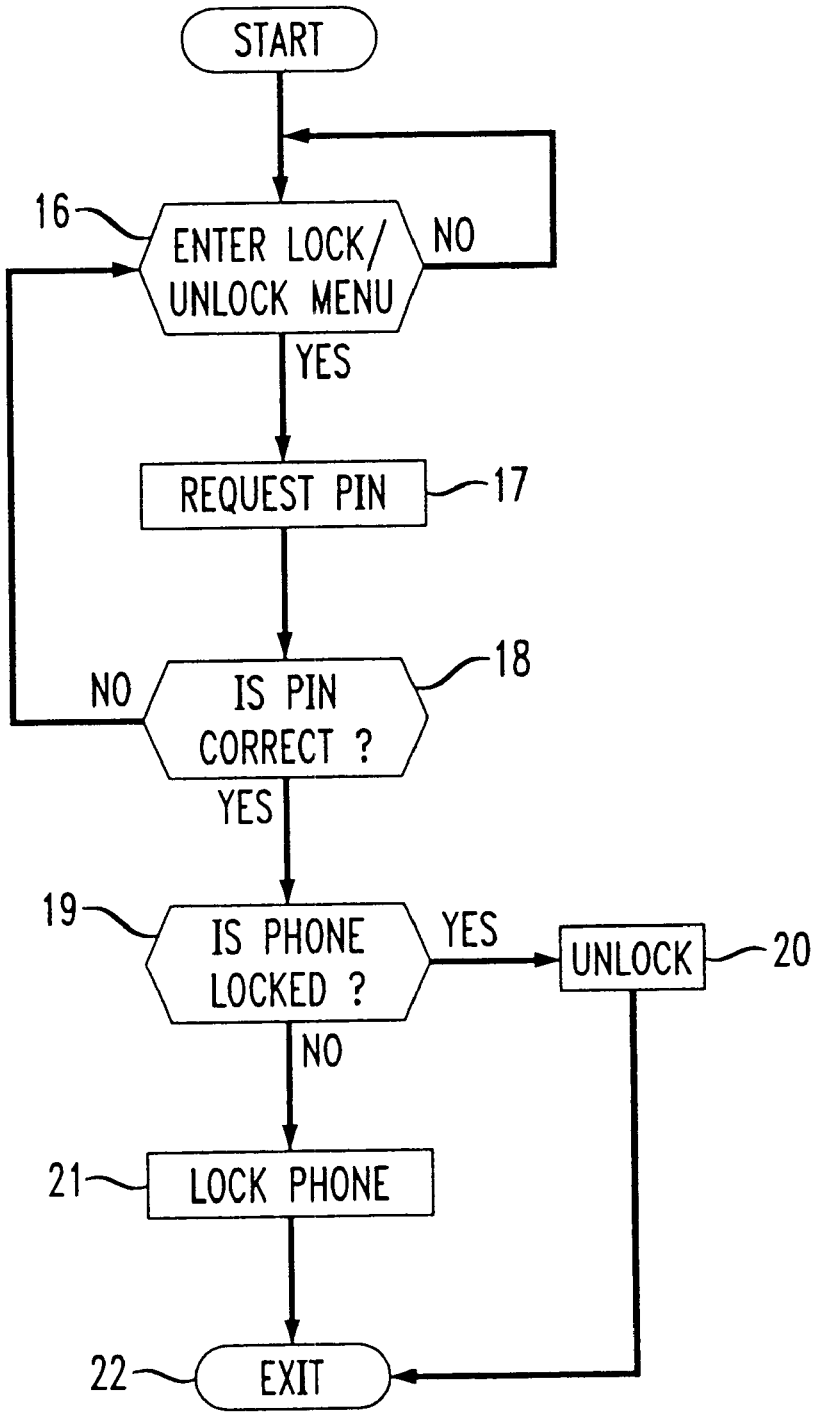
FIG. 7 PRIOR ART
FIG. 7 shows a conventional flowchart of locking and unlocking the operation of a mobile phone.

The alarm PIN is established by the mobile phone's owner in a manner similar to setting up a lock/unlock PIN as described in relation to FIG. 6 above. An alarm PIN setup menu is used to enter an alarm PIN value that is easily remembered by the mobile phone's owner.

In step 26, it is determined whether or not an alarm PIN value has been transmitted from the remote user to the mobile phone. Importantly, in accordance with the principles of the present invention, a user may call their own phone and enter an alarm PIN. Once such an alarm PIN has been entered, the remote user's alarm PIN is compared with the alarm PIN stored in the alarm PIN memory 230 of the mobile wireless device. If the proper alarm PIN has not been entered by a remote victim accessing their stolen mobile phone, the program branches back to step 25, monitoring for an alarm PIN entry. If the proper alarm PIN has been entered by a remote victim accessing their stolen mobile phone, the program proceeds to step 27, which triggers the audible alarm.

Figure 5:
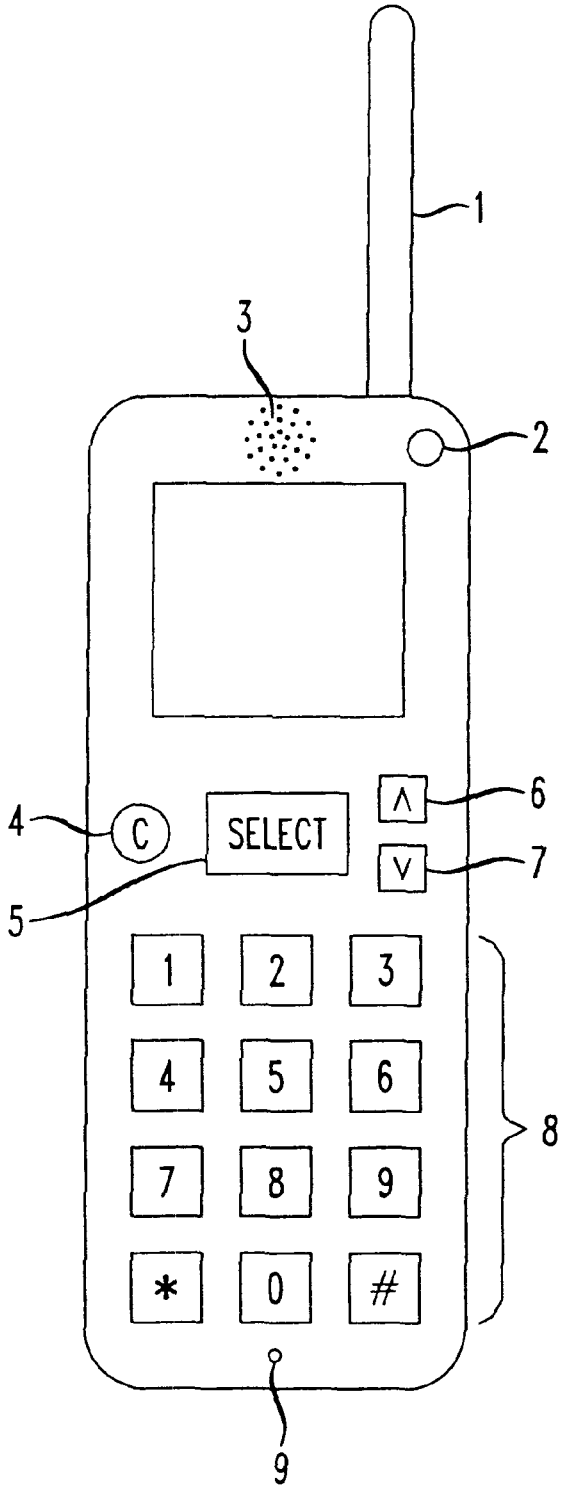
FIG. 5 PRIOR ART
FIG. 5 shows a conventional mobile phone with menu access buttons.

The audible alarm can be turned off either by entering a menu function within the mobile phone or remotely calling the phone and again entering the alarm PIN value. A menu function within the mobile phone similar to the menu described above to lock/unlock the mobile phone is used to disable the audible alarm by entry of the alarm PIN through the mobile phone keypad 8, as shown in FIG. 5. Alternately, the audible alarm can be disable remotely by the mobile phone's owner again calling the mobile phone and entering an alarm PIN. An alarm PIN received a second time is used to disable the audible alarm in instances where the audible alarm is triggered by a mistaken belief the mobile phone was stolen, when it had in fact been borrowed.

The routine 28 for triggering the audible alarm is exited once the alarm is activated.

In the preferred embodiment, a default alarm sound distinct from a ringing sound used when a conventional call is made to the mobile phone is configured for the mobile phone during manufacture.

Figure 4:
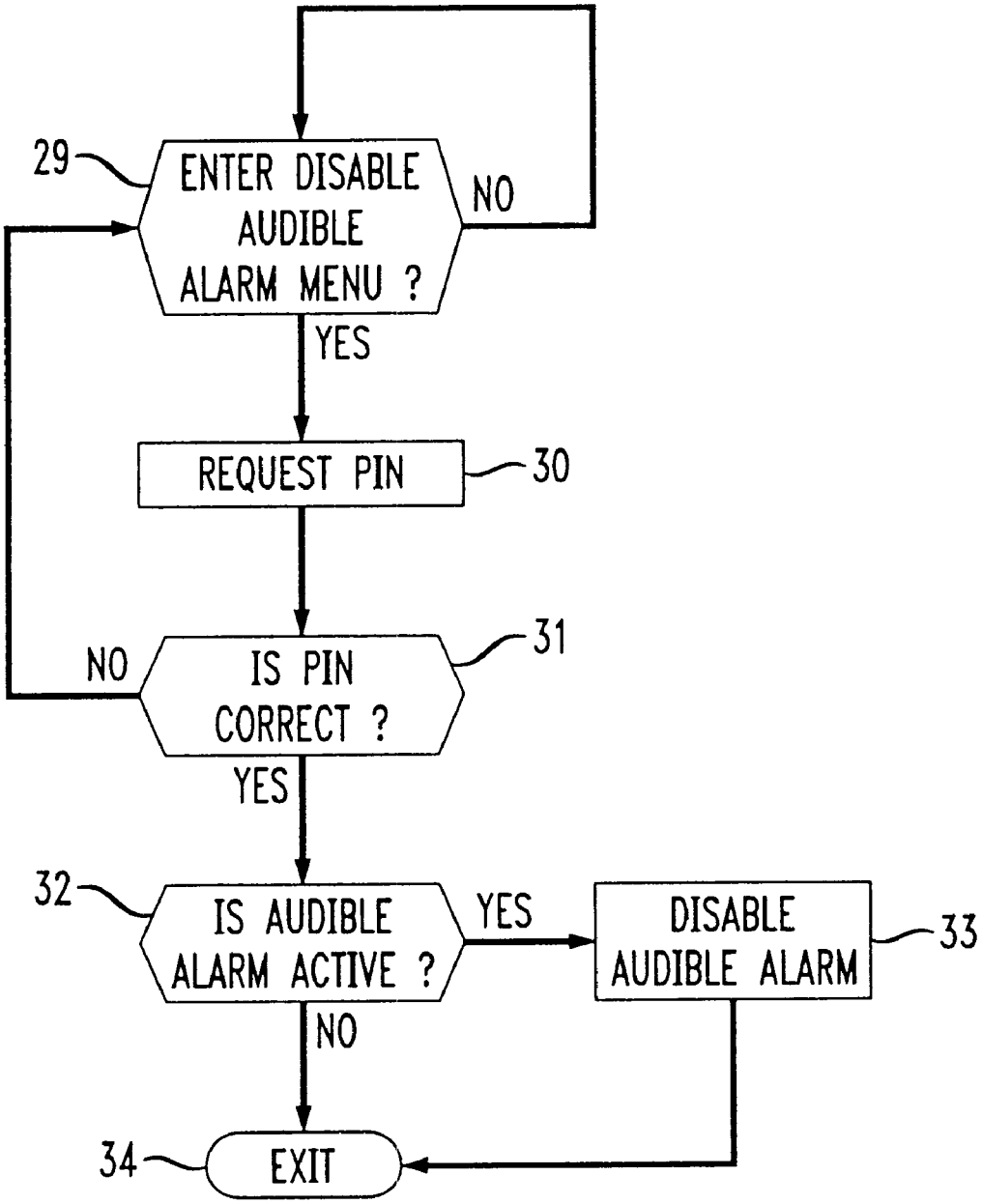
FIG. 4 shows a flow chart for disabling an audible alarm, in accordance with the principles of the present invention.

FIG. 4 shows a flow chart for disabling an audible alarm, in accordance with the principles of the present invention.

In particular, FIG. 4 shows exemplary steps used to deactivate a mobile phone in accordance with the invention.

A software routine within the mobile phone monitors if a user of the remote mobile phone desires to enter the menu for disabling the audible alarm 29. If a user desires to enter the routine to disable the audible alarm, the program proceeds to step 30, requesting an alarm PIN. An alarm PIN is requested by the software from the user, which is input through the exemplary keypad as shown in FIG. 5, item 8.

Once an alarm PIN has been entered by a user of the mobile phone, a determination is made if the alarm PIN is correct at step 31. To determine if the alarm PIN is correct, the entered alarm PIN value is compared to an alarm PIN value previously entered, stored in alarm pin memory 230. If the two values are identical, the program proceeds to step 32, a determination if the audible alarm is currently active. If the audible alarm is currently active, the program proceeds to step 33, disabling the audible alarm. If the audible alarm is not active, there are no further steps required and the routine to disable the audible alarm is exited 34.

The alarm 220 can be an audible alarm, a visible alarm such as on the mobile wireless device's display, a vibrating alarm, and/or any other suitable form of activating a sensory output of the mobile wireless device.

In an alternative embodiment, the audible alarm can be configured by a mobile wireless user to allow unique identification, e.g., to find their misplaced mobile phone in a crowded place. The unique audible alarm preferably is distinguishable from a typical audible ring indicating an incoming call.

In one alternative embodiment, an alarm PIN can be entered by a remote user desiring access to the mobile wireless device even without the mobile wireless device becoming off-hook. An alarm PIN would immediately be entered by the remote user, and an alarm PIN is sent from a service provider, such as through a Global System for Mobile Communications (GSM) short message or via the service provider itself. The PIN can be sent over any of the mobile device's receive channels. In the alternate embodiment, the mobile wireless device would operate as described above to activate the audible alarm.

In an alternate embodiment, the alarm PIN is stored at a central location remote from the mobile phone. When a user desires to trigger the alarm, the user enters the alarm PIN, as described above, at a remote location. The alarm PIN is then compared to a previously entered alarm PIN at a central location. A proper alarm PIN then causes an alarm trigger signal to be transmitted from the central location to the mobile phone. The mobile phone processes the alarm trigger signal to trigger the alarm on the mobile phone.

In yet another embodiment, the triggering of the alarm of the mobile phone is used in conjunction with a disablement of the phone. Therefore, the mobile phone will not only provide a sensory warning of a theft, but would also leave the mobile phone unusable.

Although the present invention is described with reference to embodiments for triggering an audible alarm in a mobile phone, the principles of the present invention are equally applicable to the remote triggering of alarms in other types of stolen mobile receiving devices, e.g, in a Personal Digital Assistant (PDA), in a pager, in a laptop, in a portable digital radio, etc.

While the invention has been described with reference to the exemplary embodiments thereof, those skilled in the art will be able to make various modifications to the described embodiments of the invention without departing from the true spirit and scope of the invention.

What is claimed is:

1. A method of remotely triggering an alarm within a mobile wireless device, said method comprising:

receiving an alarm trigger signal from a service provider to said mobile wireless device based on user authorization;

triggering a sensory output from said mobile wireless device based on receipt of said alarm trigger signal from said service provider; and preventing a current holder of said mobile wireless device from stopping said sensory output unless an alarm PIN is manually entered by said holder into said mobile wireless device.

2. The method of remotely triggering an alarm within a mobile wireless device according to claim 1, wherein:

said sensory output is an audible alarm.

3. The method of remotely triggering an alarm within a mobile wireless device according to claim 1, wherein:

said sensory output is a visible alarm on a display.

4. The method of remotely triggering an alarm within a mobile wireless device according to claim 1, wherein:

said alarm is configurable.

5. The method of remotely triggering an alarm within a mobile wireless device to claim 1, further comprising:

comparing said alarm PIN to a previously entered alarm PIN stored in said mobile wireless device.

6. The method of remotely triggering an alarm within a mobile wireless device according to claim 1, wherein:

said mobile wireless device is a wireless phone.

7. The method of remotely triggering an alarm within a mobile wireless device according to claim 1, wherein:

said mobile wireless device is a personal data assistant.

8. The method of remotely triggering an alarm within a mobile wireless device according to claim 1, wherein:

said mobile wireless device is a pager.

9. The method of remotely triggering an alarm within a mobile wireless device according to claim 1, wherein:

said mobile wireless device is a personal computer.

10. A remotely triggering means for an alarm within a mobile wireless device comprising:

means for receiving an alarm trigger signal from a service provider to said mobile wireless device based on user authorization; and means for triggering a sensory output based on receipt of said alarm trigger signal from said service provider; and means for preventing a current holder of said mobile wireless device from stopping said sensory output unless an alarm PIN is manually entered by said holder into said mobile wireless device.

11. The remotely triggering means for an alarm within a mobile wireless device according to claim 10, wherein:

said sensory output is an audible alarm.

12. The remotely triggering means for an alarm within a mobile wireless device according to claim 10, wherein:

said sensory output is a visible alarm on a display.

13. The remotely triggering means for an alarm within a mobile wireless device according to claim 10, wherein:

said sensory output is configurable.

14. The remotely triggering means for an alarm within a mobile wireless device to claim 10, further comprising:

a means for comparing said alarm PIN to a previously entered alarm PIN stored in said mobile wireless device.

15. The remotely triggering means for an alarm within a mobile wireless device according to claim 10, wherein:

said mobile wireless device is a wireless phone.

16. The remotely triggering means for an alarm within a mobile wireless device according to claim 10, wherein:

said mobile wireless device is a personal data assistant.

17. The remotely triggering means for an alarm within a mobile wireless device according to claim wherein:

said mobile wireless device is a pager.

18. The remotely triggering means for an alarm within a mobile wireless device according to claim 10, wherein:

said mobile wireless device is a laptop computer.

19. The remotely triggering means for an alarm within a mobile wireless device according to claim 10, further comprising:

means for authorizing said alarm PIN in said received alarm trigger signal.

20. The method of remotely triggering an alarm within a mobile wireless device according to claim 1, wherein:

said alarm trigger signal is transmitted to said mobile wireless device while said mobile wireless device is off-hook.

21. The method of remotely triggering an alarm within a mobile wireless device according to claim 1, further comprising:

periodically transmitting said alarm trigger signal to said mobile wireless device until a confirmation signal is received indicating that said mobile device has activated said sensory output.

22. The method of remotely triggering an alarm within a mobile wireless device according to claim 1, further comprising:

turning said sensory output off upon receipt of a second reception of said alarm trigger signal.

23. The method of remotely triggering an alarm within a mobile wireless device according to claim 1, wherein:

said sensory output is distinctive from a ring associated with ordinary receipt of a phone call.

24. The method of remotely triggering an alarm within a mobile wireless device according to claim 1, further comprising:

disabling ordinary operation of said mobile device when said alarm trigger signal is received to activate said sensory output.

* * * * *